US006345160B1

(12) United States Patent
Matsuo et al.

(10) Patent No.: US 6,345,160 B1
(45) Date of Patent: Feb. 5, 2002

(54) ELECTROPHOTOGRAPHIC IMAGE FORMING APPARATUS

(75) Inventors: Kazuyoshi Matsuo; Akira Sasaki, both of Hitachi; Masahiko Saito, Kitaibaraki; Shinichi Hosaka, Takahagi; Nobuaki Fukasawa, Hitachi, all of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/633,822

(22) Filed: Aug. 7, 2000

(30) Foreign Application Priority Data

Aug. 10, 1999 (JP) ..... 11-226074

(51) Int. Cl.[7] ..... G03G 15/00; G03G 15/01

(52) U.S. Cl. ..... 399/53; 399/43

(58) Field of Search ..... 399/53, 43, 38, 399/29, 82, 85, 99, 222, 252, 273, 283

(56) References Cited

U.S. PATENT DOCUMENTS 5,963,768 A * 10/1999 Rhee ..... 399/283

6,067,427 A * 5/2000 Shin ..... 399/53

FOREIGN PATENT DOCUMENTS

JP 54-141647 * 11/1979

* cited by examiner

*Primary Examiner*—Sophia S Chen
(74) *Attorney, Agent, or Firm*—Antonelli, Terry, Stout & Kraus, LLP

(57) ABSTRACT

An electrophotographic image forming apparatus is capable of restriction or elimination of the occurrence of a density fluctuation, such as a lateral stripe, and thereby can enhance the image quality. The electrophotographic image forming apparatus includes a photosensitive body, exposure device for forming an electrostatic latent image on the photosensitive body, at least two developers for developing the electrostatic image in mutually distinct colors for respectively forming toner images of mutually distinct colors, a transfer device for transferring the toner images of mutually distinct colors on a printing medium in an overlapping manner, and a fixing device for fixing the toner images transferred onto the printing medium. When one of the developers is maintained inoperative, that developer is forcedly operated for a reset operation thereof.

13 Claims, 4 Drawing Sheets

ELECTROPHOTOGRAPHIC IMAGE FORMING APPARATUS

BACKGROUND OF THE INVENTION

The present invention relates generally to an electrophotographic image forming apparatus. More particularly, the invention relates to an electrophotographic image forming apparatus which is suitable for forming a color image.

An electrophotographic image forming apparatus operates to obtain image data to print from a personal computer and to print the image data on a printing medium, such as a sheet of paper. More particularly, the electrophotographic image forming apparatus develops the image data into bitmap information and then turns a laser ON and OFF on the basis of the bitmap information for irradiating a laser beam onto a photosensitive body, such as a photosensitive drum, photosensitive film and the like. By irradiation of the laser beam, an electrostatic latent image is formed on the photosensitive body. The electrostatic latent image is developed into a toner image to be transferred onto the printing medium, such as paper, to form a printed image. The image formed on the printing medium is fixed by heating.

When a color image is formed on the printing medium, the image data from the personal computer or the like is developed into individual bitmap data per color. Then, the latent image corresponding to each color is formed and developed at successive times. For instance, at first, a latent image corresponding to magenta image is formed and developed, and then, a latent image corresponding to a yellow image is formed.

As set forth above, the electrophotographic image forming apparatus having a color printing capability is provided with a plurality of developer units. If a particular developer unit is operated continuously for a time in excess of a given period, a density fluctuation, such as a lateral stripe, may be caused in an output image. For example, such a problem is caused when color printing is performed after a large amount of a printing of monochrome image is performed.

A study for the cause of the problem set forth above has been made by the applicants. As a result, it has been found that, while the developer unit for one color corresponding to a single color mode is in operation, the developer rollers of other developers are continuously opposed to the charged belt surfaces so that toner depositing on the surface of the developer roller is subject to the influence of the electrical charge of the charged belt. As a result, the toner is firmly bound with the roller so as to interfere with the formation of a uniform charged toner layer on the peripheral surface of the developer roller. This can be a cause of fluctuation in the developed image.

SUMMARY OF THE INVENTION

The present invention provides an electrophotographic image forming apparatus which can restrict or eliminate the occurrence of a density fluctuation, such as lateral stripe and, thereby, can enhance the image quality.

According to the first aspect of the present invention, an electrophotographic image forming apparatus comprises: a photosensitive body; exposure means for forming an electrostatic latent image on the photosensitive body; at least two developer means for developing the electrostatic latent image in mutually distinct colors for respectively forming toner images of mutually distinct colors; transfer means for transferring the toner images of mutually distinct colors on a printing medium in an overlapping manner; fixing means for fixing the toner images transferred onto the printing medium; and when one of the developer means is maintained inoperative, that developer means is forcedly operated in a reset state.

In the preferred construction, the electrophotographic image forming apparatus may further comprise an intermediate transfer body to which is transferred a plurality of toner images, and an image formed on the intermediate transfer body is then transferred to the printing medium. One of the developer means may be held inoperative during a monochrome printing sequence. The color painting sequence may be performed after forcedly operating the one of the developer means in reset state.

In the alternative, the forced operation of the one of developer means may involve rotation of a developer roller therein.

According to the second aspect of the present invention, an electrophotographic image forming apparatus comprises: a photosensitive body; exposure means for forming an electrostatic latent image on the photosensitive body; at least two developer means for developing the electrostatic latent image in mutually distinct colors for respectively forming toner images of mutually distinct colors; transfer means for transferring the toner images of mutually distinct colors on a printing medium in an overlapping manner; fixing means for fixing the toner images transferred onto the printing medium; counting means for counting the number of printed pages; judgment means for making a judgment as to whether one of the developer means has been held inoperative during printing of a predetermined number of pages; and the one of the developer means is operated on the basis of a judgment made by the judgment means.

According to the third aspect of the present invention, a color electrophotographic printing apparatus comprises: a photosensitive body to be exposed by image data per each color for forming an electrostatic latent image thereon; means for developing the electrostatic latent image of each color on the photosensitive body with a corresponding color of toner; an intermediate transfer body receiving toner images of respective colors on the photosensitive body in an overlapping manner for forming a multi-color toner image; means for transferring the multi-color image formed on the intermediate transfer body onto a printing medium; means for fixing the multi-color toner image on the printing medium by thermal fixing; the color electrophotographic printing apparatus having a single color printing sequence for performing outputting of a single color image by operating only developing means corresponding to a color of the input image data when only image data of one color is input, the color electrophotographic printing apparatus also having a developer means resetting sequence operative after printing in the single color printing sequence for a large number of times, if image data requiring operation of the developer means which is held inoperative during the single color printing sequence, is input, for returning a surface condition of a developer roller in the developer means to a normal state continuously subject to influence of an electrical charge on the surface of the photosensitive body during execution of the single color printing sequence, before initiating a printing operation with operation of the developer means which is held inoperative during the single color printing sequence.

Preferably, when the single color printing sequence is repeated for a number of times greater than or equal to a predetermined, the developer means which is held inoperative during the single color printing sequence is operated regularly for preventing the surface of the developer roller from becoming abnormal and, thereby, for returning the surface condition of the developer roller to a normal state.

According to the fourth aspect of the present invention, an electrophotographic image forming apparatus comprises: printer unit including latent image forming means, latent image developing means provided for each printing color for developing the latent image to form toner image corresponding to the latent image, toner image transferring means for transferring, the toner image onto a printing medium, and image fixing means for fixing the toner image on the printing medium, the printing unit being operative at least in a single color printing mode where only one of the image developing means is operated and the remaining image developing means are held inoperative and a multi-color printing mode where a plurality of image developing means are operated; monitoring means for monitoring the condition of the image developing means during the single color printing mode of operation of the printer unit for detecting an abnormal state of the image developing means; and normalizing means responsive to the monitoring means detecting an abnormal state of the image developing means for performing a normalizing process for normalizing the image developing means in an abnormal state before initiation of operation in the multi-color printing mode operation.

The monitoring means may count up the number of printed pages in the single color printing mode for detecting an abnormal state of the image developing means when a counter value becomes greater than or equal to a predetermined criterion. The normalizing means may be responsive to the monitoring means detecting the abnormal state of the image developing means for performing an initialization process.

According to the fifth aspect of the present invention, an electrophotographic image forming apparatus comprises: a printer unit including latent image forming means, latent image developing means provided for each printing color for developing the latent image to form a toner image corresponding to the latent image, toner image transferring means for transferring the toner image onto a printing medium, and image fixing means for fixing the toner image on the printing medium, the printing unit being operative at least in a single color printing mode where only one of the image developing means is operated and the remaining image developing means are held inoperative and a multi-color printing mode where a plurality of image developing means are operated; and normalizing means operative at every predetermined number of pages of print in the single color printing mode for performing a normalizing process for maintaining the image developing means in a normal state.

The normalizing means may operate the image transferring means for causing transfer of an image on the image developing means held in the inoperative state during the single color printing mode the operation.

BRIEF DESCRIPTION OF THE DRAWINGS

The present invention will be understood more fully from the detailed description given hereinafter and from the accompanying drawings of a preferred embodiment of the present invention, which, however, should not be taken to be limitative to the invention, but has been presented for explanation and understanding only.

In the drawings.

DESCRIPTION OF THE PREFERRED EMBODIMENT

The present invention will be discussed hereinafter in detail in terms of a preferred embodiment of the present invention with reference to the accompanying drawings. In the following description, numerous specific details are set forth in order to provide a thorough understanding of the present invention. It will be obvious, however, to those skilled in the art that the present invention may be practiced without these specific details. In addition, some well-known structure has not been shown in detail in order to avoid unnecessary obscurity of the present invention.

Figure 4:
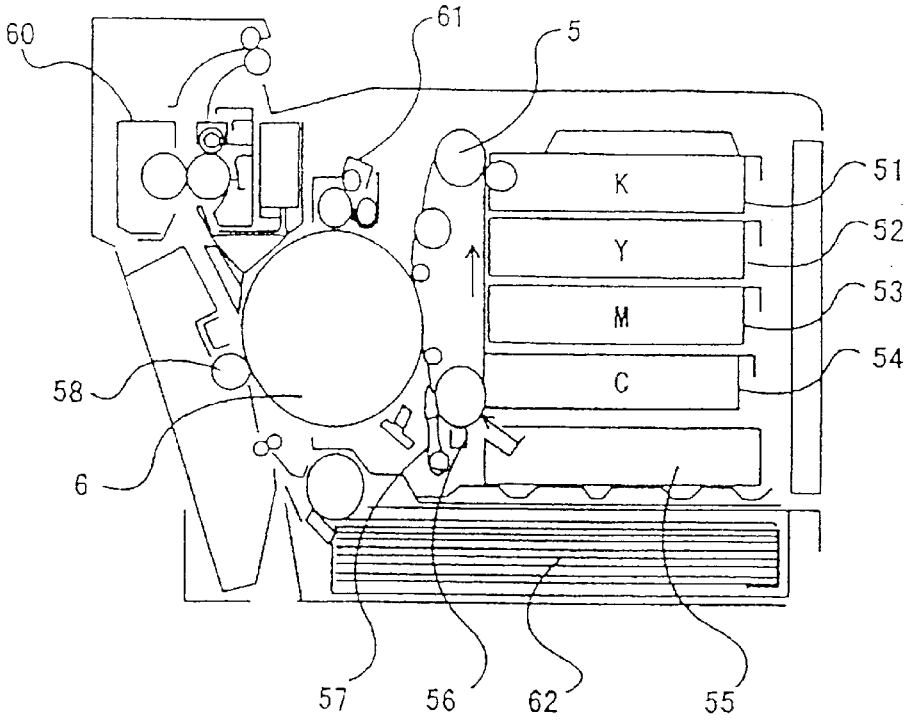
FIG. 4 is a diagrammatic illustration showing the general construction of the preferred embodiment of the electrophotographic image forming apparatus according to the present invention.

At first, the general construction of a preferred embodiment of a color photographic printing apparatus will be discussed with reference to FIG. 4. A photosensitive unit 5, including a belt having an organic photosensitive material (hereinafter referred to as "OPC" or "photosensor") applied on a surface thereof, is driven to rotate in a direction shown by the arrow during an image forming operation. A belt cleaner 57 removes residual toner on the surface of the belt of the photosensitive unit 5 after completion of image formation per each color. A charger 56 applies an electrical charge necessary for forming an electrostatic latent image on the surface of the belt of the photosensitive unit 5. A laser beam emitted from an optical unit 55 is irradiated on the surface of the belt surface of the charged photosensitive unit 5 for exposure to form the electrostatic latent image.

Developers 51 to 54 develop the latent image formed on the surface of the belt of the photosensitive unit 5 with a black toner being applied at a first time, a cyan toner being applied at a second time, a magenta toner being applied at a third time and a yellow toner being applied at a fourth time, in this sequential order. An intermediate transfer drum 6 is driven to rotate while maintaining contact with the photosensitive unit 5. Therefore, toner images of block toner, cyan toner, magenta toner and yellow toner formed on the surface of the belt of the photosensitive unit 5 are transferred to the intermediate transfer drum 6 in sequential order (first transfer) in an overlapping manner for forming a multi-color toner image. A transfer roller (hereinafter referred to as "transfer means" occasionally) 58 applies an electric field of reverse polarity from a back side of a printing medium 62 which is fed across an image transfer portion, for transferring the color toner image formed on the intermediate transfer drum 6 onto the printing medium (second transfer). A fixing unit 60 melts the toner transferred on the printing medium 62 by heating for fixing the image transferred thereon. A drum cleaner 61 removes residual toner on the intermediate transfer drum 6 after transfer of the color toner image on the intermediate transfer drum onto the printing medium 62.

Upon outputting a full color image by the color electrophotographic printer, color-coded imagq data is input per each individual color for exposure of the belt surface o the photosensitive unit 5 to form the electrostatic latent image. The electrostatic latent image thus formed on the surface of the belt of the photosensitive unit 5 is developed by one of the developers corresponding to the color of the image data to form the toner image of the corresponding color. The toner image thus formed is transferred to the intermediate transfer drum. These operations are repeatedly performed for respective colors. By repeating the foregoing operations, the toner images of four colors are overlaid on the intermediate transfer drum to form the multi-color toner image. Then, the printing medium, such as a printing paper, is fed across the image transfer portion so that the multi-color toner image as a whole is transferred onto the printing medium. Toners of respective colors forming the multi-color toner image are molten by heating for fixing the formed image on the printing medium. Thereafter, the printed product is ejected. The speed of such a type of electrophotographic printer is expressed by numbbr of times the foregoing sequence of printing operations is carried out per minute. For instance, when the foregoing printing operation is performed four times within one minute, the process speed is expressed as 4 PPM (page per minute).

The foregoing operation is adapted for printing or outputting a full color image. However, when such a color electrophotographic printer is used as a network printer in an office, the printer is frequently used for monochrome (single color of black) printing or dual color printing of text data. In such case, it is wasteful to operate the printer in the full color printing mode for data of monochrome or dual color printing. Therefore, the printer is provided with a plurality of operation modes, such as single color mode, a two color mode, a three color mode and so forth. By printing in these operation modes, a higher process speed can be achieved. Namely, for example, in the case of a color electrophotographic printer having a capability of full color printing of 4 PPM, a process speed of 16 PPM may be achieved in the single color mode. Therefore, when it is desired to output a large number of pages of monochrome data, a four times greater amount of printing can be obtained in comparison with the case where printing is performed in a full color or four color mode.

Figure 2A:
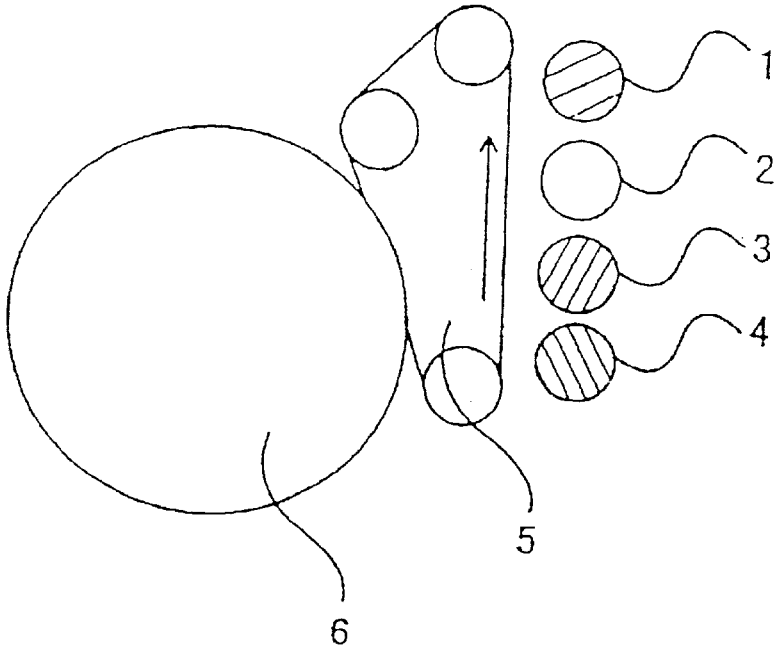
FIGS. 2A and 2B are diagrams showing components associated with image formation in the preferred embodiment of the electrophotographic image forming apparatus according to the present invention.
Figure 2B:
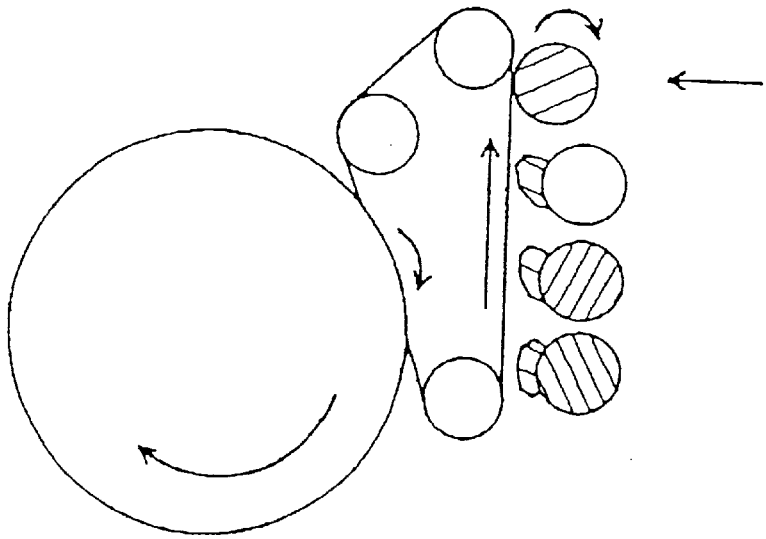

FIGS. 2A and 2B are diagrammatic illustrations showing a relationship between the developers, the photosensitive belt and the intermediate transfer drum for forming an image. The reference numerals 1 to 4 denote rollers (developer rollers) of a developer in contact with a photosensitive belt 9 forming the toner image. During a waiting state, as shown, the developer rollers 1 to 4 are displaced away from the surface of the photosensitive belt surface so as to form a predetermined gap therewith.

Figure 3A:
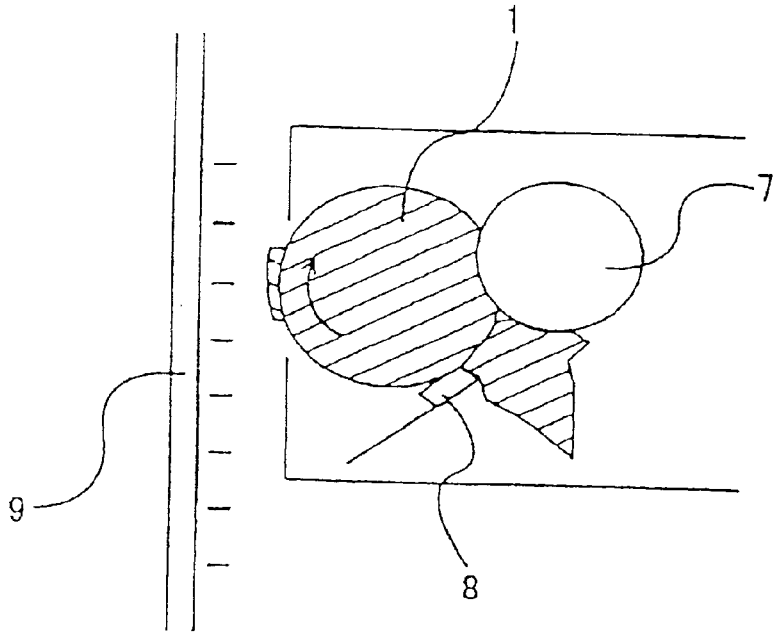
FIGS. 3A and 3B are diagrams showing a structure of a developer employed in the preferred embodiment of the electrophotographic image forming apparatus according to the present invention.
Figure 3B:
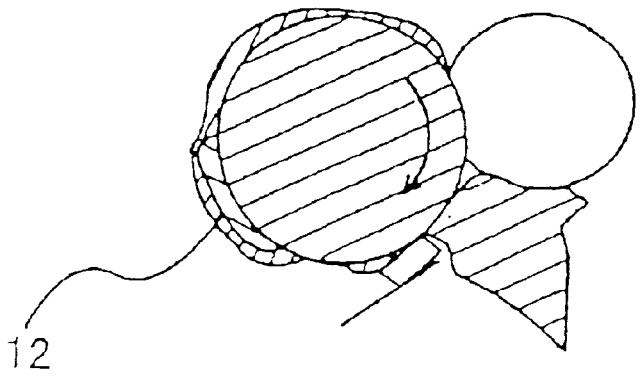

As shown in FIG. 2B, during a developing operation, a not shown developer unit body is urged onto the belt by a not shown drive mechanism in a direction shown by the arrow. Then, the photosensitive belt is circulated and the developer roller is rotated respectively in directions shown by the arrows to form the toner image on the belt. In case of the single color mode, a particular one of the developer rollers (developer roller 1 in the illustrated case) is constantly urged onto the surface of the photosensitive belt 9, as shown in FIG. 2B. At this time, the other developer rollers (developer rollers 2 to 4 in the illustrated case) are held away from the surface of the photosensitive belt in opposition to the belt surface to be influenced by the electric electrical charge of the photosensitive belt. FIGS. 3A and 3B are diagrammatic illustrations showing the construction around the developer roller. The developer roller 1 charges the toner by friction with a charging blade 8 which is biased onto the surface of the developer roller for establishing friction contact, for forming a layer of charged toner on the roller surface. The reference numeral 7 denotes a reset roller for removing residual toner on the roller surface after developing. The toner 12 deposited on a portion of the developer roller 1 is subject to the electrical charge on the photosensitive belt so as to be firmly bound on the surface of the developer roller, thereby to cause difficulty in removal by the reset roller 7. Over such portion, a toner layer of low charge amount is formed in the next charge to differentiate the developing condition from other portions, thereby to cause fluctuation of the density in the image. Thus, the resultant output image becomes defective.

It should be noted that the detailed construction of the electrophotographic image forming apparatus or the electrophotographic printer set forth above has been disclosed in commonly owned U.S. Pat. No. 5,555,074 to Haragakiuchi et al. and commonly owned U.S. Pat. No. 6,081,683 to Miyasala et al., for example. The disclosure of the above-identified U.S. Patents are hereby incorporated by reference.

Figure 1:
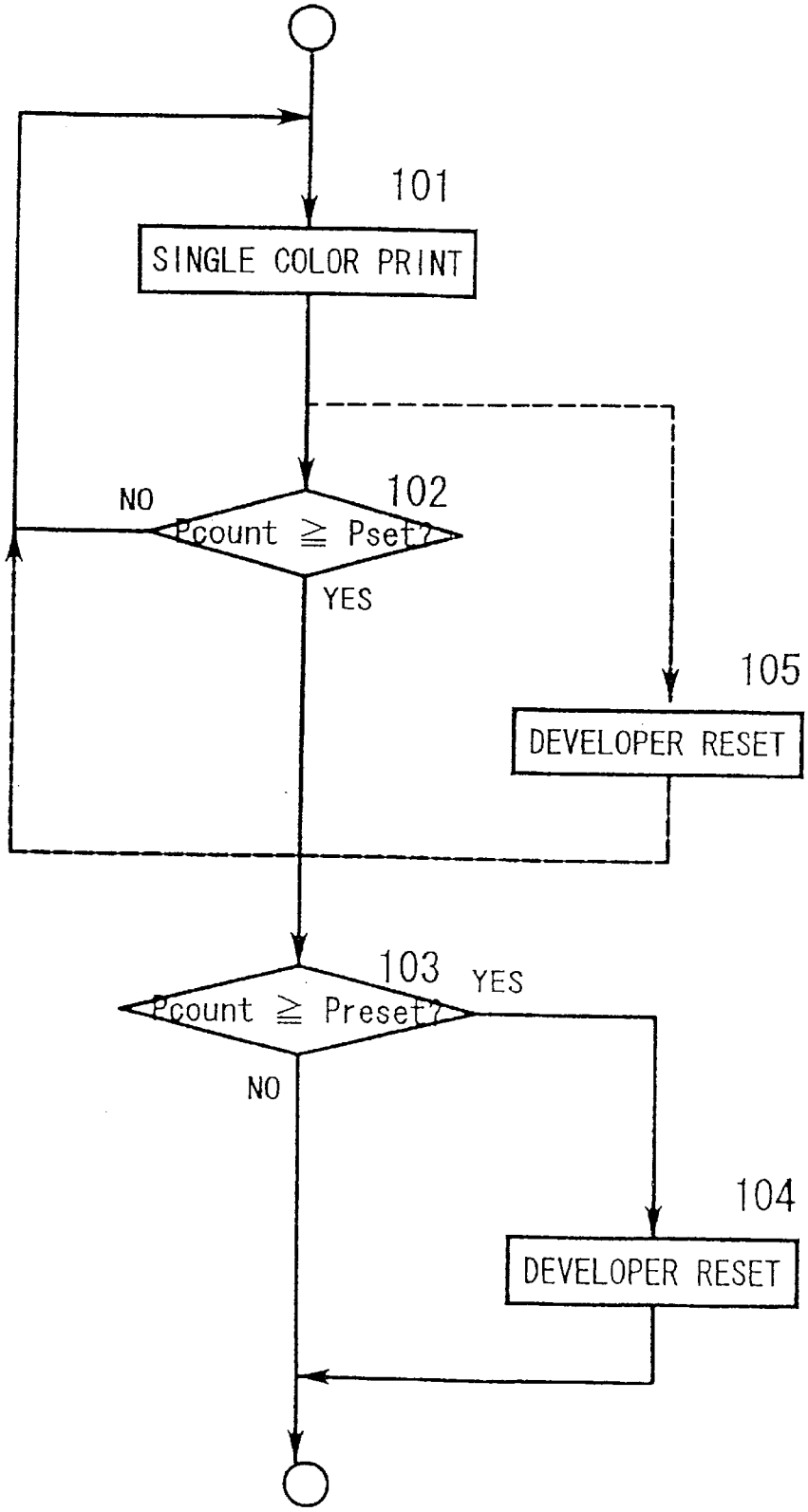
FIG. 1 is a flowchart showing a sequence of an image forming operation of the preferred embodiment of an electrophotographic image forming apparatus according to the present invention.
Figure 5:
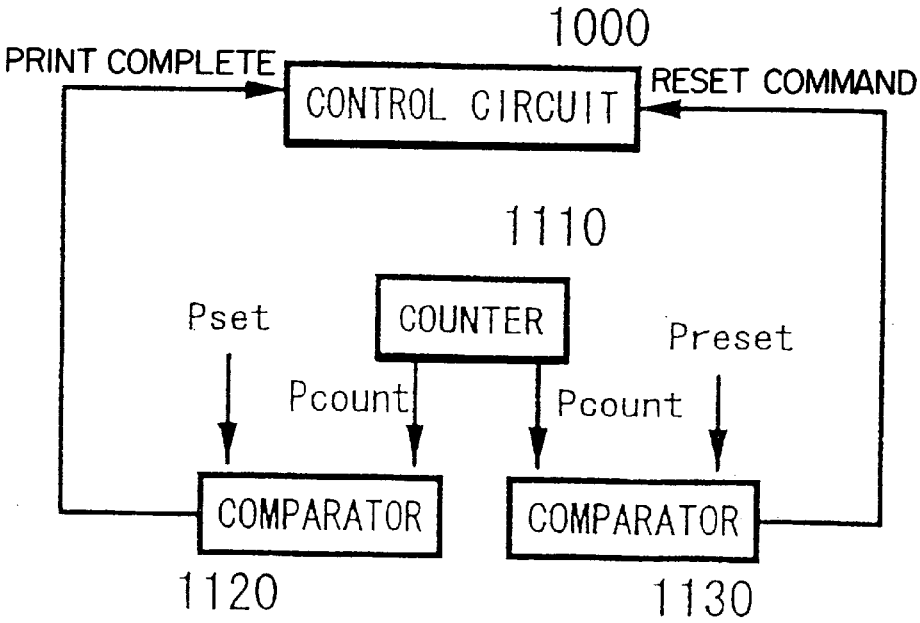
FIG. 5 is a schematic block diagram showing a circuit for performing a developer reset sequence according to the process shown in FIG. 1.

However, the problem set forth above can be resolved after a printing operation involving printing of several pages so as to return to a normal state and may not be chronic problem. In order to avoid the outputting of the defective image, when an image output requiring an operation of the developers being kept in an inoperative condition after continuous printing of a large number of pages in a single color mode (in this case, it is merely required to count the number of printed pages), it is effective to perform a developer resetting sequence for returning the surface conditions of the developer rollers to a normal state. FIG. 1 is a flowchart generally showing system operation in the case where the developer resetting sequence is included. FIG. 5 is a schematic block diagram showing a control circuit 1000 which includes a developer reset controller. The control circuit 1000 may have the circuit construction and function as disclosed in U. S. Pat. No. 5,555,074, for example, except for the developer reset controller. The developer reset controller includes a counter 1110 for counting the number of printed pages by counting every time there is a completion of printing for one page. The counter 1110 outputs a counter signal $P_{count}$ indicative of the number of printed pages. The counter signal $P_{count}$ of the counter 1110 is output to a first comparator 1120. To the first comparator 1120, a preset page number indicative signal $P_{set}$ is input which represents a number of pages to print, as preset by a user. The first comparator 1120 outputs a print completion indicative signal when the counter signal $P_{count}$ becomes greater than or equal to the preset page number indicative signal $P_{set}$. The control circuit 1000 is responsive to the print completion indicative signal to terminate the printing operation. The counter signal $P_{count}$ is also fed to a second comparator 1130. To the second comparator 1130, a reference signal is input providing a criterion for performing developer reset operation. The second comparator 1130 outputs a reset command signal to the control circuit 1000. The control circuit 1000 is responsive to the reset command signal to perform a predetermined developer reset operation.

The developer reset sequence will be further discussed with reference to FIG. 1. In the sequence shown in FIG. 1, a process at step 101 is to perform a sequence for single color printing. At each time of completion of the sequence of single color printing at step 101 for one page, the count of printed pages is incremented by one. Then, the printed page $P_{count}$ is compared with a preliminarily set number of pages to print $P_{set}$ as the preset page number indicative signal, at step 102. If the count of the printed page $P_{count}$ is less than the set number of pages to print $P_{set}$, the sequence of single color printing is performed again. The single color printing operation is repeated until the count $P_{count}$ becomes greater than or equal to the set number $P_{set}$. Once the count $P_{count}$ reaches the set number $P_{set}$, judgment is made at step 102 that single color printing is completed. Then, a check is performed to determine whether the developer reset operation is necessary or not at step 103. In practice, the count $P_{count}$ is compared with a predetermined developer reset criterion $P_{reset}$ as the reference signal for checking whether the developer reset operation is necessary or not. The developer reset criterion $P_{reset}$ may be determined experimentally and represents the number of sequentially printed pages in single color printing that potentially will cause sticking of the toner on the developer roller, thereby to cause a density fluctuation in the printed image. When the count $P_{count}$ is greater than or equal to the developer reset criterion $P_{reset}$ as checked at step 103 and sticking of the toner on the developer roller potentially has been caused, a developer reset operation (hereinafter referred to as a developer normalizing operation) is performed at step 104. In practice, the developer normalizing operation may simply consist of initializing the developers per each color as performed upon starting up of the electrophotographic printer.

In the alternative, it is also possible to perform a developer reset operation at every predetermined number of pages printed at step 105 as shown by the broken lines in FIG. 1. For this purpose, a threshold value representing the predetermined number of pages printed is set at a smaller value than the developer reset criterion $P_{reset}$ so that a developer reset operation can be performed at every predetermined number of pages of print during a single color printing operation. By performing the developer reset operation at step 105, the process at steps 103 and 104 become unnecessary.

As set forth above, by performing the developer reset operation when the signal color mode printing is continuously performed for a number of pages in excess of the developer reset criterion or at every predetermined number of pages during single color mode printing, the developer roller can be normalized to avoid the occurrence of a density fluctuation in subsequent printing requiring operation of the developers which are held inoperative during former single color mode printing. Therefore, the electrophotographic image forming apparatus makes it possible to obtain high quality printing products.

Although the present invention has been illustrated and described with respect to an exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodied within a scope encompassed and equivalent thereof with respect to the feature set out in the appended claims.

What is claimed is:

1. An electrophotographic image forming apparatus comprising:

a photosensitive body;

exposure means for forming an electrostatic latent image on said photosensitive body;

at least two developer means for developing said electrostatic latent image in mutually distinct colors for respectively forming toner images of mutually distinct colors;

transfer means for transferring said toner images of mutually distinct colors on a printing medium in an overlapping manner;

fixing means for fixing the toner images transferred onto said printing medium; and when one of said developer means is maintained inoperative, that one developer means is forcedly operated for reset operation thereof.

2. An electrophotographic image forming apparatus as set forth in claim 1, which further comprises an intermediate transfer body on which is transferred a plurality of toner images, and an image formed on said intermediate transfer body is transferred to said printing medium.

3. An electrophotographic image forming apparatus as set forth in claim 1, wherein said one of said developer means is held inoperative during a monochrome printing sequence.

4. An electrophotographic image forming apparatus as set forth in claim 3, wherein a color printing sequence is performed after forcedly operating said one of said developer means for a reset operation.

5. An electrophotographic image forming apparatus as set forth in claim 3, wherein said forced operation of said one of said developer means is rotation of a developer roller therein.

6. An electrophotographic image forming apparatus comprising:

a photosensitive body;

exposure means for forming an electrostatic latent image on said photosensitive body;

at least two developer means for developing said electrostatic latent image in mutually distinct colors for respectively forming toner images of mutually distinct colors;

transfer means for transferring said toner images of mutually distinct colors on a printing medium in an overlapping manner;

fixing means for fixing the toner images transferred onto said printing medium;

counting means for the counting number of printed pages; and judgment means for making a judgment as to whether one of developer means is held inoperative during printing of a predetermined number of pages wherein said one of developer means is operated on the basis of a judgment made by said judgment means.

7. A color electrophotographic printing apparatus comprising:

a photosensitive body to be exposed on the basis of image data per each color for forming an electrostatic latent image thereon;

means for developing said electrostatic latent image of each color on said photosensitive body with a corresponding color of toner;

an intermediate transfer body receiving toner images of respective colors on said photosensitive body in an overlapping manner for forming a multi-color toner image;

means for transferring said multi-color image formed on said intermediate transfer body onto a printing medium;

means for fixing said multi-color toner image on said printing medium by thermal fixing;

said color electrophotographic printing apparatus having a single color printing sequence for performing outputting of a single color image by operating only developing means corresponding to a color of the input image data when only image data of one color is input for any color, said color electrophotographic printing apparatus also having a developer resetting sequence operative after printing in said single color printing sequence for a large number of times, if image data requiring operation of said developer means which is held inoperative during said single color printing sequence, is input, for returning a surface condition of a developer roller in said developer means to a normal state continuously subject to influence of an electrical charge on the surface of said photosensitive body during execution of said single color printing sequence, before initiating printing with operation of said developer means which is held inoperative during said single color printing sequence.

8. A color electrophotographic printing apparatus as set forth in claim 7, wherein when said single color printing sequence is repeated for a number of times greater than or equal to a predetermined number, said developer means which is held inoperative during said single color printing sequence is operated regularly for preventing the surface of said developer roller from becoming abnormal, thereby returning the surface condition of the developer roller to a normal state.

9. An electrophotographic image forming apparatus comprising:

a printer unit including latent image forming means, latent image developing means provided for each printing color for developing a latent image to form a toner image corresponding to said latent image, toner image transferring means for transferring the toner image onto a printing medium, and image fixing means for fixing the toner image on said printing medium, said printing unit being operative at least in a single color printing mode where only one of said image developing means is operated and remaining image developing means are held inoperative and a multi-color printing mode where a plurality of image developing means are operated;

monitoring means for a monitoring condition of said image developing means during said single color printing mode operation of said printer unit for detecting an abnormal state of said image developing means; and normalizing means responsive to said monitoring means detecting an abnormal state of said image developing means for performing a normalizing process for normalizing said image developing means in an abnormal state before initiation of operation in said multi-color printing mode operation.

10. An electrophotographic image forming apparatus as set forth in claim 9, wherein said monitoring means counts up the number of printed pages in said single color printing mode for detecting an abnormal state of said image developing means when a counter value becomes greater than or equal to a predetermined criterion.

11. An electrophotographic image forming apparatus as set forth in claim 9, wherein said normalizing means is responsive to said monitoring means detecting an abnormal state of said image developing means for performing an initialization process.

12. An electrophotographic image forming apparatus comprising:

a printer unit including latent image forming means, latent image developing means provided for each printing color for developing a latent image to form a toner image corresponding to said latent image, toner image transferring means for transferring the toner image onto a printing medium, and image fixing means for fixing the toner image on said printing medium, said printing unit being operative at least in a single color printing mode where only one of said image developing means is operated and remaining image developing means are held inoperative and a multi-color printing mode where a plurality of image developing means are operated; and normalizing means operative at every predetermined number of pages printed in said single color printing mode for performing a normalizing process for maintaining said image developing means in a normal state.

13. An electrophotographic image forming apparatus as set forth in claim 12, wherein said normalizing means operates said image transferring means for causing transfer of an image on said image developing means held in an inoperative state during a single color printing mode of operation.

* * * * *